US006260295B1

(12) United States Patent
Nickel

(10) Patent No.: US 6,260,295 B1
(45) Date of Patent: Jul. 17, 2001

(54) SCORCH PREVENTING ELECTRIC FLATIRON

(75) Inventor: Charles A. Nickel, Huntsville, AL (US)

(73) Assignee: The Nickelworks, Inc., Huntsville, AL (US)

( * ) Notice: Subject to any disclaimer, the term of this patent is extended or adjusted under 35 U.S.C. 154(b) by 0 days.

(21) Appl. No.: 09/640,160

(22) Filed: Aug. 16, 2000

Related U.S. Application Data

(63) Continuation-in-part of application No. 09/250,319, filed on Feb. 16, 1999, now Pat. No. 6,105,285.

(51) Int. Cl.[7] ..... D06F 75/40
(52) U.S. Cl. ..... 38/79
(58) Field of Search ..... 38/79, 96, 97, 38/75; 219/259

(56) References Cited

U.S. PATENT DOCUMENTS

| | | | | |
|---|---|---|---|---|
| 222,849 | | 12/1879 | Welch | 38/93 |
| 1,920,668 | * | 8/1933 | Reed | 38/79 |
| 2,036,504 | * | 4/1936 | Sarringar | 38/79 |
| 2,072,217 | | 3/1937 | Reed | 38/79 |
| 2,076,614 | | 4/1937 | Bowman | 38/74 |
| 2,149,251 | * | 3/1939 | Campana | 38/79 |
| 2,224,896 | | 12/1940 | Burian | 38/79 |
| 2,470,532 | | 5/1949 | Thomas | 38/79 |
| 2,501,549 | | 3/1950 | Swenson | 38/79 |
| 2,596,314 | | 5/1952 | Wales | 38/79 |
| 2,712,703 | | 7/1955 | Hilldale | 38/79 |
| 2,770,059 | | 11/1956 | Brace | 38/79 |
| 3,192,654 | | 7/1965 | Weaver | 38/77 |
| 5,966,851 | | 10/1999 | Serpa | 38/79 |
| 6,105,285 | | 8/2000 | Nickel | 38/76 |

* cited by examiner

*Primary Examiner*—Ismael Izaguirre
(74) *Attorney, Agent, or Firm*—Waddy & Patterson, P.C.; John C. Garvin, Jr.

(57) ABSTRACT

An electric flatiron which substantially eliminates the scorching or burning of fabric material to be ironed. The electric flatiron comprises a housing having a handle attached thereto, a metallic sole plate in electrical contact with electric leads, and spring urged glide assemblies secured to the housing and up to 2.5 centimeters or one inch adapted to extend below the lower surface of the sole plate when there is no or little pressure upon the handle of the housing but moves upwardly in alignment with the lower surface of the sole plate when pressure is placed upon the handle of the housing during the ironing process.

16 Claims, 7 Drawing Sheets

SCORCH PREVENTING ELECTRIC FLATIRON

This application is a continuation-in-part of application Ser. No. 09/250,319 filed Feb. 16, 1999 now U.S. Pat. No. 6,105,285.

FIELD OF THE INVENTION

This invention relates generally to an electric flatiron and more particularly to an electric flatiron which is adapted to be automatically raised above the fabric material being ironed a sufficient distance to eliminate or reduce the possibility that the fabric or other material being ironed will be scorched or burned.

BACKGROUND OF THE INVENTION

A search of U.S. patents for electric flatirons which incorporate structure which permits the lowering and raising of the hot sole plate of the flatiron into and out of contact with the material being ironed produced the following U.S. patents somewhat pertinent to applicant's invention, namely: U.S. Pat. No. 2,072,217 to Reed, U.S. Pat. No. 2,076,614 to Bowman, U.S. Pat. No. 2,712,703 to Hilldale, and U.S. Pat. No. 2,770,059 to Brace.

U.S. Pat. No. 2,072,217 to Reed is directed to a detachable lift for a flatiron for selectively raising and lowering the sole plate of the flatiron into and out of engagement with the material to be ironed dependent upon the application of pressure, or release thereof, from the handle of the flatiron. The raising of the sole plate of the flatiron from engagement with the material to be ironed eliminates the possibility of burning or scorching of the material to be ironed.

U.S. Pat. No. 2,076,614 to Bowman is directed to a flatiron mounted on a spring-urged sub-base which is adapted to engage the material to be ironed. The sub-base can be selectively forced and locked into intimate contact with the sole plate of the flatiron to facilitate the transfer of heat from the sole plate to the sub-base by downward pressure of the handle of the flatiron during the ironing process. When the ironing process is completed and pressure is removed from the handle, the springs will force the flatiron up to provide clearance between the sub-base and the sole plate to eliminate the possibility of scorching or burning of the material to be ironed.

U.S. Pat. No. 2,712,703 to Hilldale and U.S. Pat. No. 2,770,059 to Brace are directed to flatirons having mechanisms incorporated therein for selectively lowering and raising the hot sole plate of the flatiron into and out of contact with the material to be ironed. When the sole plate of the flatiron is raised out of contact with the material to be ironed or the cover of the ironing board itself, there is little likelihood of scorching or burning of either the material or the cover.

These prior art flatirons have presented many problems and disadvantages particularly when compared to the improved flatiron of the present invention. Each of the flatirons or attachments therefor disclosed in these prior art patents serves as standard flatirons with their accompanying problems of scorching or burning of materials. The primary feature of each of these prior art devices resides in a safety feature operable either before or after ironing which involve the lifting of the sole plate or the heating element away from the material being ironed. There is a need, therefore, for a relatively inexpensive electric flatiron of simple construction which substantially eliminates the scorching or burning of material to be ironed. This is especially so when the material to be ironed is silk, rayon or the like. The electric flatiron of the present invention fulfills these needs.

SUMMARY OF THE INVENTION

In accordance with the present invention as shown in FIGS. 1–5, a simple and inexpensive flatiron is provided which substantially eliminates the scorching or burning of fabric material to be ironed. The flatiron of the present invention generally comprises a metallic sole plate with a plurality of spaced bores therein, a conventional molded housing having a handle, and spring urged ball bearing glide assemblies mounted within each spaced bore within the sole plate having heating elements therein which are in electrical contact in a conventional fashion to electrical leads.

When incorporated in a flatiron of the steam variety, the present invention, as shown in FIGS. 1–5, has two modes of operation during the ironing process, namely: a natural up-mode wherein the flatiron rides on a plurality of ball bearing glide assemblies with balls which extend below the lower surface of the sole plate to hold the lower surface of the sole plate out of contact with the material being ironed; and a down-mode of operation wherein pressure upon the handle of the flatiron causes the balls of the ball bearing glide assembles to be retracted upwardly beyond the lower surface of the sole plate to allow the sole plate to engage the material being ironed. When the flatiron is in its natural up-mode of operation, it possesses the unique capability of steam ironing fabric materials such as nylon, silk, and rayon, which normally scorch or burn easily, without burning or scorching the material being ironed. When the flatiron is in its natural up-mode of operation, the flatiron rides or glides on the balls of ball bearing glide assemblies during the ironing process, with the sole plate being out of engagement with the material being ironed, to eliminate or reduce the possibility of the material being scorched or burned. This raising of the flatiron off of the material being ironed also improves the steam action. When ironing material that is not easily scorched or burned as is nylon, silk or rayon, the user can apply pressure to the handle of the flatiron to place the flatiron in its down-mode of operation wherein the sole plate actually engages the material being ironed during the ironing process. When a user is not actually engaged in the ironing process, the user's release of the handle of the flatiron will cause the balls of the ball bearing glide assemblies to be extended beyond the lower surface of the sole plate to hold the sole plate out of contact with the material and/or the ironing board.

In accordance with the present invention as shown in FIGS. 6–9, a simple and inexpensive flatiron is provided which substantially eliminates the scorching or burning of fabric material to be ironed. The flatiron of the present invention as shown in FIGS. 6–9 generally comprises a conventional metallic sole plate having heating elements therein which are in electrical contact in a conventional fashion to electrical leads, a conventional molded housing having a handle, and a spring urged skirt secured to the molded housing.

When incorporated in a flatiron of the steam variety, the present invention has two modes of operation during the ironing process, namely: a natural up-mode wherein the flatiron rides on the skirt which extends below the lower surface of the sole plate to hold the lower surface of the sole plate out of contact with the material being ironed; and a down-mode of operation wherein pressure upon the handle of the flatiron causes the spring urged skirt to be retracted upwardly in alignment with the lower surface of the sole plate to allow the sole plate to engage the material being ironed. When the flatiron is in its natural up-mode of operation, its possesses the unique capability of steam ironing fabric materials such as nylon, silk, and rayon, which normally scorch or burn easily, without burning or scorching the material being ironed. When the flatiron is in its natural up-mode of operation, the flatiron rides on the skirt during the ironing process, with the sole plate being out of engagement with the material being ironed, to eliminate or reduce the possibility of the material being scorched or burned. This raising of the flatiron off of the material being ironed also improves the steam action. When ironing material that is not easily scorched or burned as is nylon, silk or rayon, the user can apply pressure to the handle of the flatiron to place the flatiron in its down-mode of operation wherein the sole plate actually engages the material being ironed during the ironing process. When a user is not actually engaged in the ironing process, the user's release of the handle of the flatiron will cause the skirt to be extended well beyond the lower surface of the sole plate to hold the sole plate out of contact with the material and/or ironing board.

The flatiron of the present invention, in all of its embodiments, is an innovative improvement in ironing all fabrics and similar materials. A principal advantage of the present invention over prior art flatirons is in its ability to glide or ride over many fabrics, such as silk, rayon, and screen printed logos, that are problems for conventional prior art irons. The flatiron of the present invention irons such fabrics without melting or streaking the fabrics. The flatiron of the present invention can steam out wrinkles without overheating the fabrics because its hot sole plate will not touch the fabric. The flatiron of the present invention can also be used as an ordinary iron by lightly applying pressure downwardly to the handle and causing the sole plate to have surface to surface contact with the fabric being ironed. The flatiron of the present invention also has a safety feature in that, left unattended, the flatiron of the present invention will not burn or scorch fabrics and/or the ironing board or start a fire in that the heating surface (sole plate) is in its normally raised position well above any fabric and/or ironing board. Further, the flatiron of the present invention does not need to rest on its heel which can be an unstable position for the flatiron.

In use, the hot sole plate in the fourth embodiment of the present invention is capable of riding up to 2.5 centimeters or one inch above the fabric being ironed. The space between the hot sole plate and the fabric being ironed is maintained as the outer skirt on which the flatiron rides compresses the fabric being ironed while allowing steam to reach the fabric being ironed. The outer skirt is preferably made of a metallic material the same or very similar to that of the sole plate. Since there is no metallic contact between the hot sole plate and the outer skirt no heat is being conducted to the outer skirt.

Accordingly, it is an object of the present invention to provide a scorch preventing electric flatiron made up of readily available, inexpensive, components and capable of being assembled by a relatively inexperienced person.

It is a further object of the present invention to provide an electric flatiron which is adapted to automatically raise the hot sole plate of the flatiron above the material being ironed when hand pressure is removed from the handle of the flatiron.

It is another object of the present invention to provide an electric flatiron which can ride or glide on the balls of ball bearing glide assemblies during one mode of operation of the ironing process to hold the sole plate of the flatiron out of contact with the material being ironed to reduce or eliminate the possibility of scorching or burning of the material being ironed.

It is yet another object of the present invention to provide an electric flatiron which will permit the balls of the ball bearing glide assemblies incorporated in the flatiron to move or recede upwardly to the lower surface of the sole plate during one mode of operation to allow the lower surface of the sole plate to engage the material being ironed during the ironing process.

It is also an object of the invention as shown in FIGS. 6–9 to provide an electric flatiron which can ride on a spring urged outer skirt during one mode of operation of the ironing process to hold the sole plate of the flatiron out of contact with the material being ironed to reduce or eliminate the possibility of scorching or burning of the material being ironed.

It is still yet another object of the invention as shown in FIGS. 6–9 to provide an electric flatiron which will permit the spring urged outer skirt associated with the flatiron to move upwardly to a plane equal to the lower surface of the sole plate during one mode of operation to allow the lower surface of the sole plate to engage the material being ironed during the ironing process.

These objects as well as other objects of the present invention will become more readily apparent from the following description taken in conjunction with the accompanying drawings.

DETAIL DESCRIPTION OF THE PREFERRED EMBODIMENT

Figure 1:
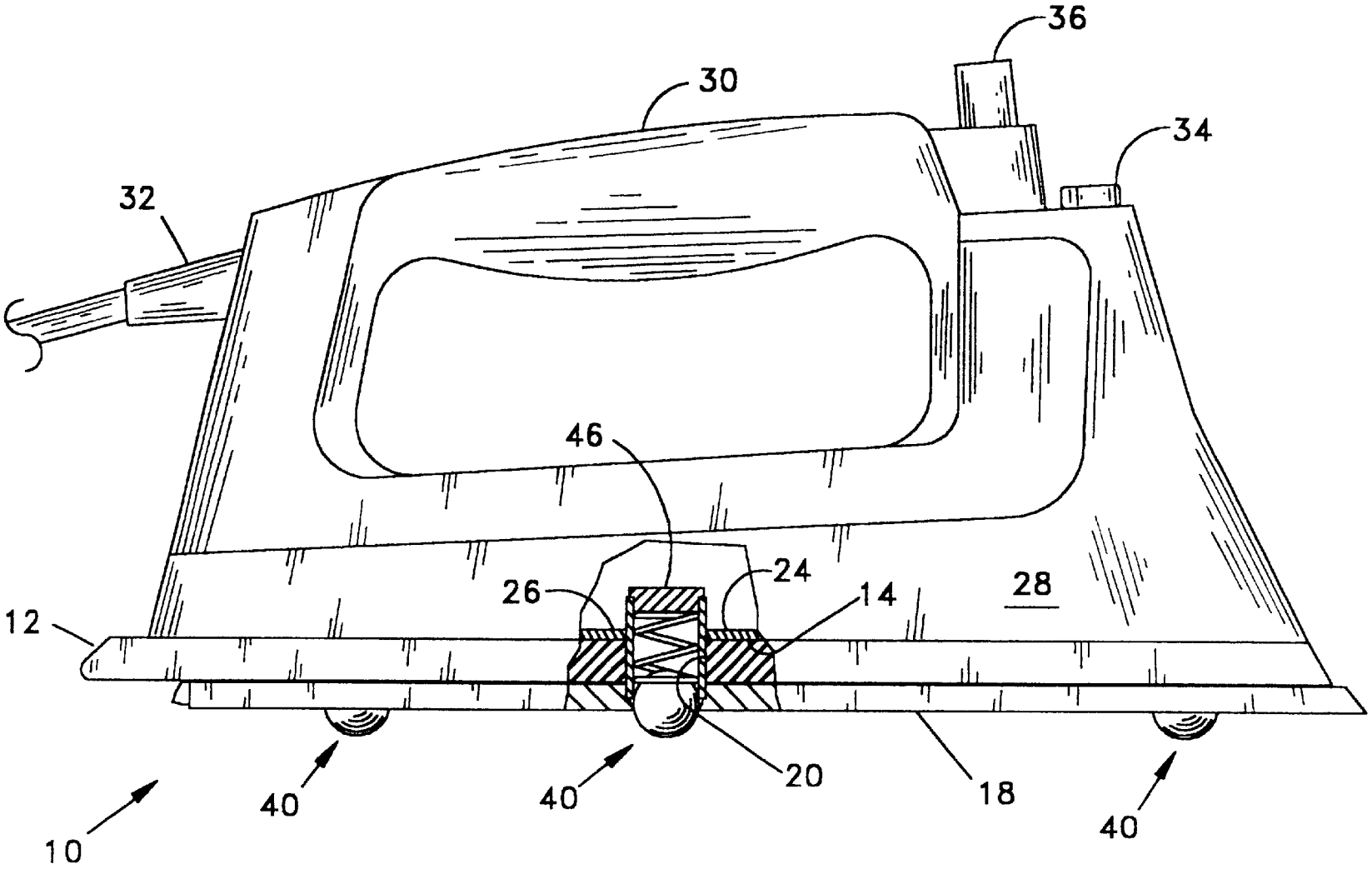
FIG. 1 is a side elevational view, partially broken away and in cross section, of an electric flatiron incorporating a first embodiment of the invention and showing the balls of the ball bearing glide assemblies in their extended position.

Referring now to FIG. 1 of the drawings, reference numeral 10 designates a conventional electric flatiron having the first embodiment of the present invention incorporated therein. The conventional electric flatiron 10 generally comprises a metallic sole plate 12 having heating elements (not shown) incorporated therein in electrical contact in a conventional fashion to electrical leads 32, a plastic sheet 24 overlying the sole plate 12 for restricting the transfer of heat from sole plate 12 to other parts of flatiron 10 which are located above the plastic sheet 24, a molded housing 28 having a handle 30 located above the plastic sheet 24, a water inlet 34 in communication with a water regulator 36 and a main water source (not shown) within molded housing 28 in communication with a water reservoir 16 incorporated in the upper surface 14 of sole plate 12, and a plurality of spaced openings 22 (FIG. 2) in sole plate 12 for emitting steam onto a fabric material (not shown) to be ironed. The structure described hereinabove constitutes the major parts of a conventional steam electric flatiron 10. A conventional flatiron which does not emit steam generally incorporates the same structure as that described for a conventional steam flatiron except for the water inlet 34, main water source (not shown), main water regulator 36, water reservoir 16 and the plurality of spaced openings 22 in the sole plate 12.

Figure 2:
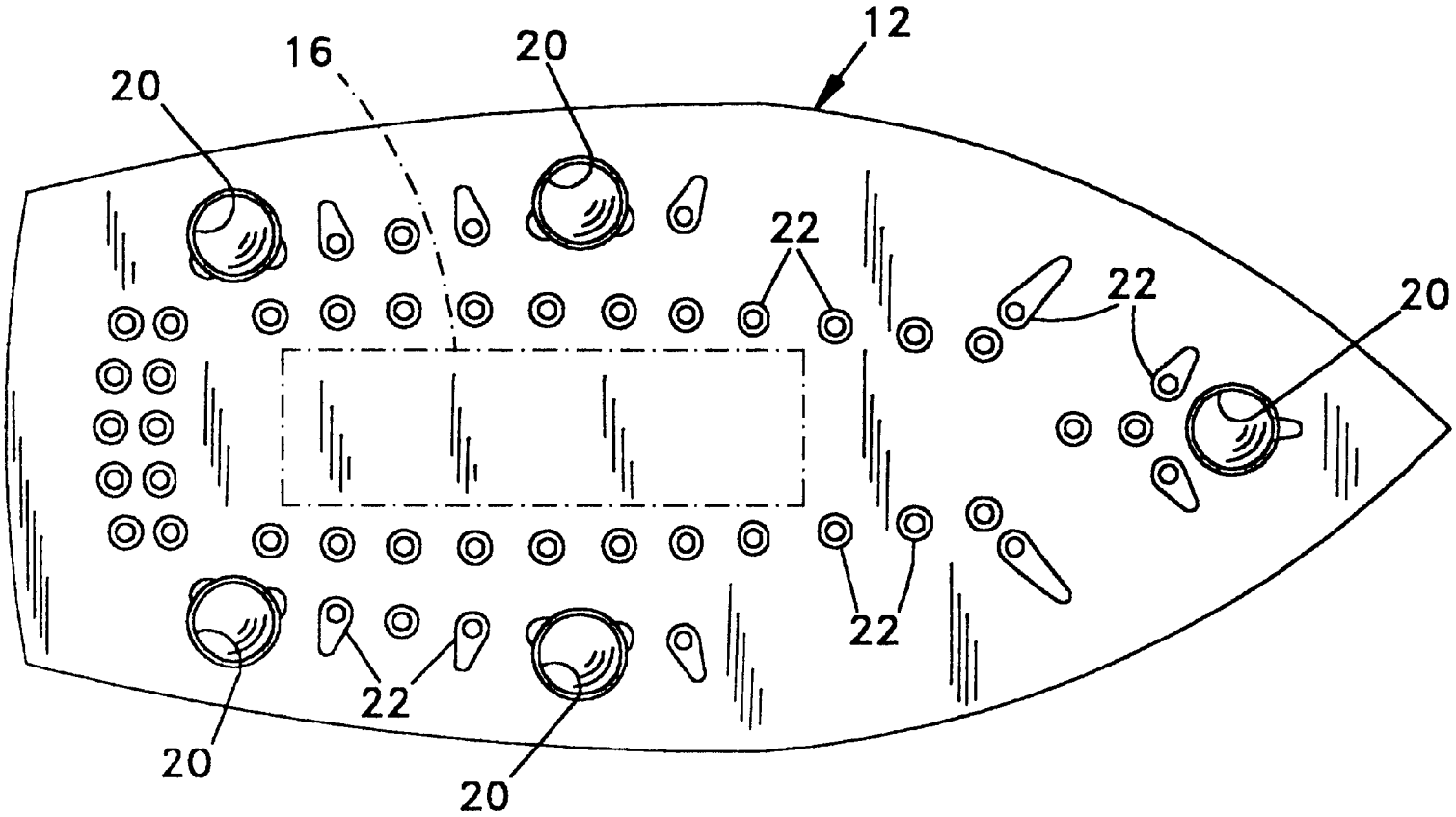
FIG. 2 is a bottom view of the sole plate of a conventional flatiron showing the bores therein, the water reservoir and the openings for emitting steam.
Figure 3:
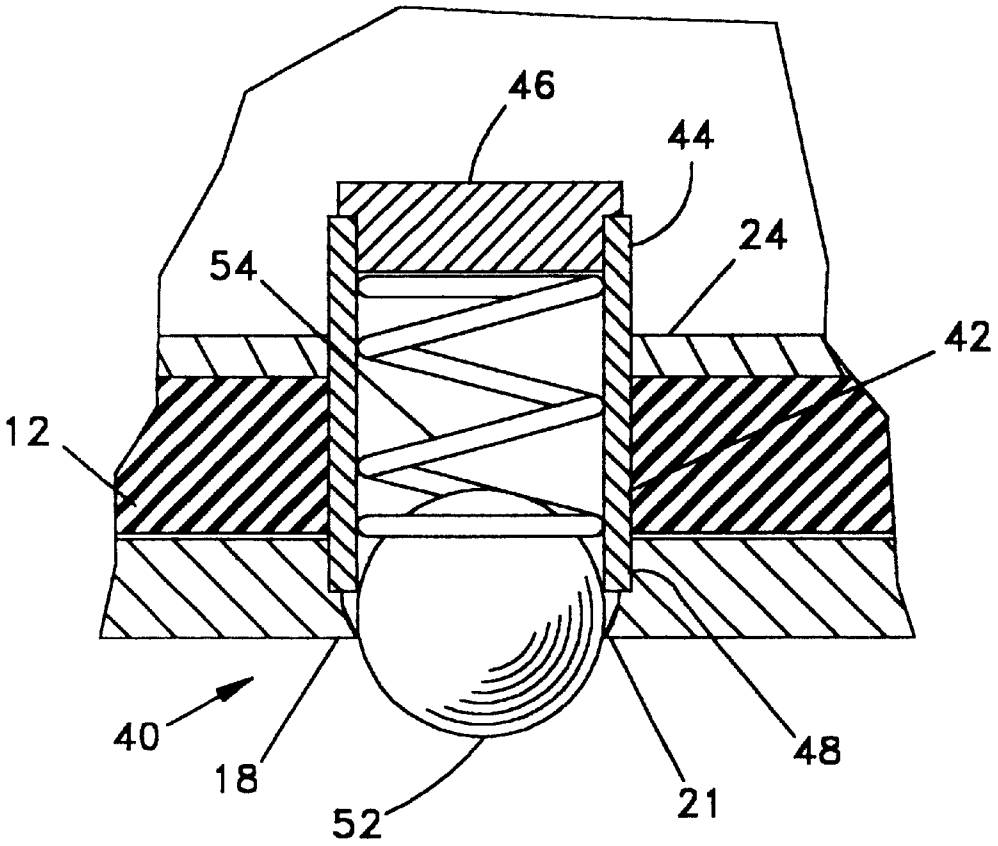
FIG. 3 is a fragmentary sectional view of the ball bearing glide assembly, the sole plate and a plastic sheet incorporated in the first embodiment of the invention.

The first embodiment of the improvement to the conventional flatiron 10, whether of the steam or non-steam variety, is best shown in FIGS. 1 and 3. In the improved version of flatiron 10, a plurality of spaced bores 20 and 26 are provided in metallic sole plate 12 and plastic sheet 24, with a spaced bore 20 in sole plate 12 being in alignment with a spaced bore 26 in plastic sheet 24. As best seen in FIG. 3, the sole plate 12 has a projection 21 which protrudes within each bore 20 of sole plate 12 adjacent its lower surface 18. As best seen in FIGS. 1 and 3, a ball bearing glide assembly 40 is frictionally fit within each of aligned bores 20 and 26. Each ball bearing glide assembly 40 comprises a hollow sleeve 42 having an upper end 44 and a lower end 48; a round ball 52 mounted partially within each hollow sleeve 42; a cap 46 secured to the upper end 44 of hollow sleeve 42; and a compression spring 54 mounted within each hollow sleeve 42 and being in contact with a respective round ball 52 and cap 46. In the first embodiment of the invention as illustrated in FIGS. 1–3, the round balls 52 normally protrude beyond the under surface 14 of metallic sole plate 12 in the order of 3.175 millimeters to 6.35 millimeters or one-eighth to one-quarter of an inch due to the urging of a respective compression spring 54. The inwardly protruding projections 21 on sole plate 12 retain the balls 52 within a respective sleeve 42.

Figure 4:
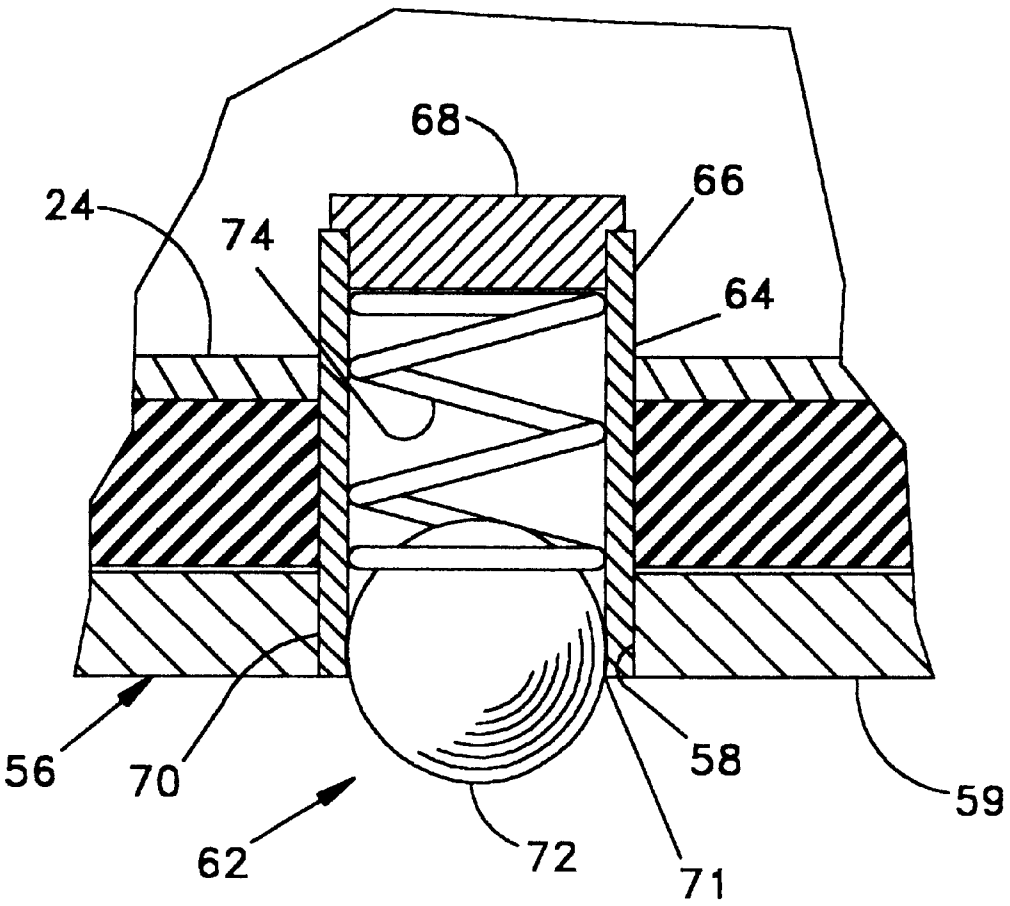
FIG. 4 is an enlarged fragmentary, cross sectional, view of the sole plate, a plastic sheet and a ball bearing glide assembly incorporated in the second embodiment of the invention.

In the second embodiment of the invention as illustrated in FIG. 4, reference numeral 56 designates a metallic sole plate having an under surface 59 and a plurality of bores 58 therein, and a plurality of ball bearing glide assemblies 62. Each ball bearing glide assembly 62 of the second embodiment comprises a hollow sleeve 64 having an upper end 66 and a lower end 70 with an inwardly protruding projection 71; a cap 68 secured to the upper end 66 of sleeve 64; a round ball 72 adjacent the lower end 70 of hollow sleeve 64; and a compression spring 74 mounted within each hollow sleeve 64 for acting on a respective cap 68 and ball 72 to normally urge a respective ball 72 such that it protrudes beyond the undersurface 59 of sole plate 56 in the order of one-eighth to one-quarter inches. The inwardly protruding projection 71 on the lower end 70 of each hollow sleeve 64 retains a respective ball 72 within a respective hollow sleeve 64.

Figure 5:
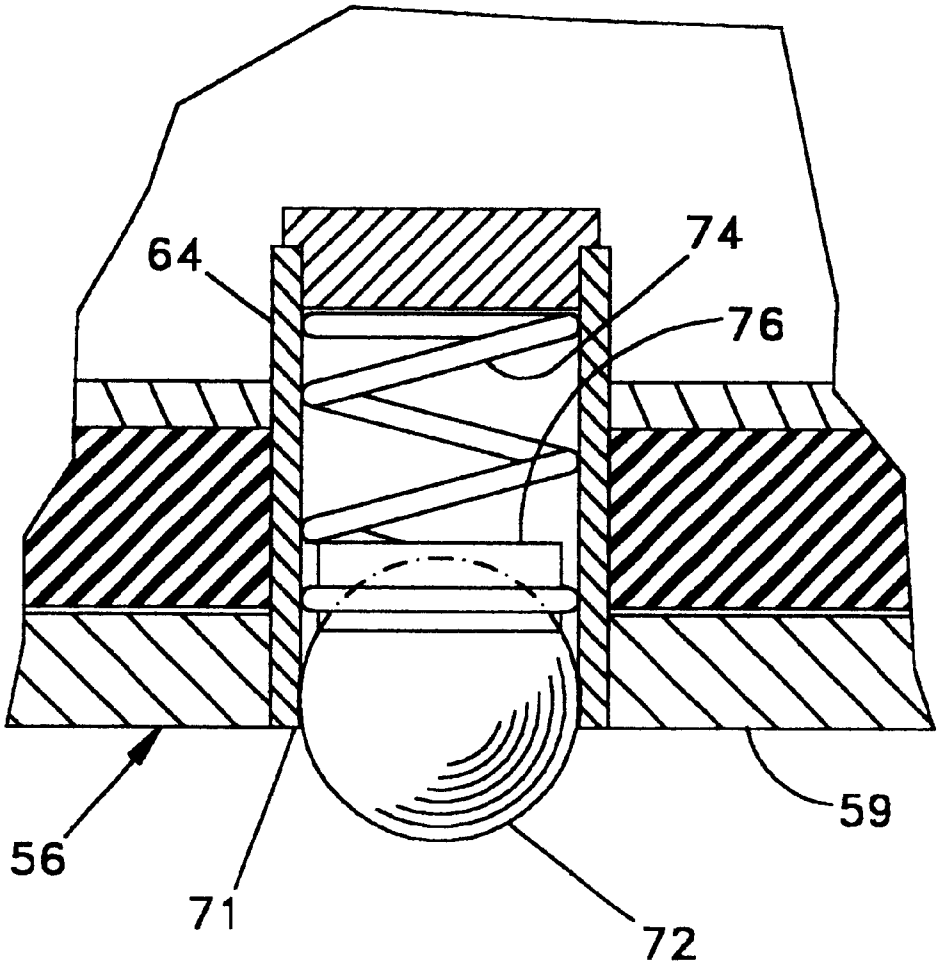
FIG. 5 is an enlarged fragmentary, cross sectional, view of the sole plate, a plastic sheet, and a ball bearing glide assembly incorporated in a third embodiment of the invention.

In the third embodiment of the invention as illustrated in FIG. 5, an insert 76, preferably made of nylon or a suitable plastic material, is provided between each compression spring 74 and each ball 72 to assist in avoiding possible corrosion of compression spring 74 from steam being emitted from the flatiron 10. It is to be understood that the insert 76 could be used in all embodiments of the invention including that depicted in FIGS. 1 and 3.

The round balls 52 and 72 are preferably made from ceramic or glass but they could be made from stainless steel or other suitable material. Balls 52 and 72 made from a ceramic or glass material are preferable in that they would be less likely to retain or transmit heat. Sheet 24 is preferably made from a thermoplastic material in that such will not be detrimentally affected by the heat coming from metallic sole plate 12.

The embodiment of the invention depicted in FIGS. 1 and 3 can be operated in either of two modes, namely: a natural up-mode when ironing material such as nylon, silk and rayon which can be easily scorched or burned, and a down-mode when ironing material such as cotton which is less likely to scorch or burn. In the natural up-mode, each ball 52, due to the ball 52 being urged beyond the lower surface 18 of metallic sole plate 12 by a compression spring 54, rides or glides over the material being ironed and in spaced relation thereto to reduce or eliminate the possibility of scorching or burning of a material being ironed when such material is nylon, silk or rayon. In the down-mode when a person applies pressure upon handle 30 of flatiron 10 during the actual ironing process, the pressure upon the handle 30 will cause the balls 52 to rise against the urging of compression springs 54 to allow the lower surface 18 of metallic sole plate 12 to engage the material to be ironed during the ironing process. When the person releases the pressure upon handle 30 of flatiron 10, the compression springs 54 will urge the balls 52 in the order of 3.175 millimeters to 6.35 millimeters or one-eighth to one-quarter inch below the lower surface 18 of metallic sole plate 12 to disengage contact between lower surface 18 of metallic sole plate 12 or 56 with the material to be ironed. The inwardly protruding projections 21 hold the balls 52 partially within the hollow sleeves 42 of glide assemblies 40.

The embodiments of the invention depicted in FIGS. 4 and 5 can likewise be operated in two modes, namely a natural up-mode when ironing materials such as nylon, silk and rayon which can be easily scorched or burned, and a down-mode when ironing materials such as cotton which is less likely to scorch or burn. In the natural up-mode of operation, each ball 72, due to the ball 72 being urged beyond the lower surface 59 of metallic sole plate 56 by a compression spring 74, rides or glides over the material being ironed and in spaced relation thereto to reduce or eliminate the possibility of scorching or burning of a material being ironed when such material is nylon, silk or rayon or similar material. In the down-mode, when a person applies pressure upon handle 30 of flatiron 10 during the actual ironing process, the pressure upon the handle 30 will cause the balls 72 to rise against the urging of compression springs 74 to allow the lower surface 59 of metallic sole plate 56 to engage the material to be ironed during the ironing process. When the person releases the pressure upon handle 30 of flatiron 10, the compression springs 74 will urge the balls 72 in the order of 3.175 millimeters to 6.35 millimeters or one-eighth to one-quarter inch below the lower surface 59 of metallic sole plate 56 to disengage contact between lower surface 59 of metallic sole plate 56 with the material to be ironed. The inwardly protruding projections 71 hold the balls 72 partially within the hollow sleeves 64 of the glide assemblies 62.

Figure 6:
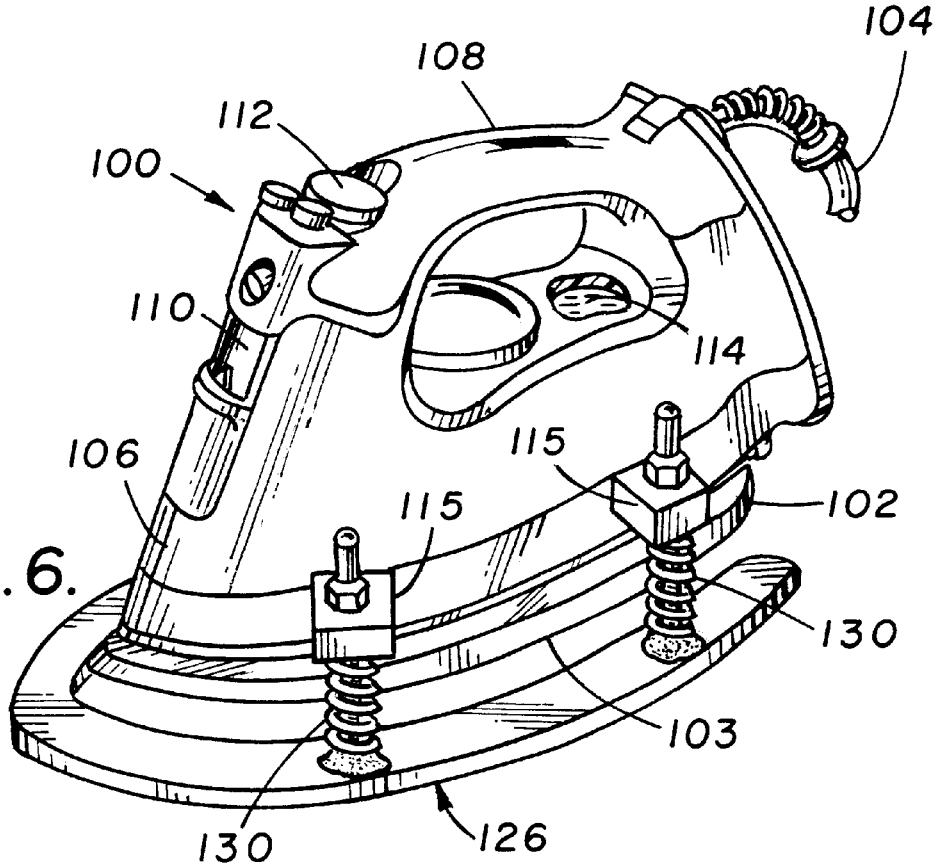
FIG. 6 is a perspective, partially broken away, view of a fourth embodiment of an electric steam iron of the present invention showing the outer skirt in an extended position.
Figure 7:
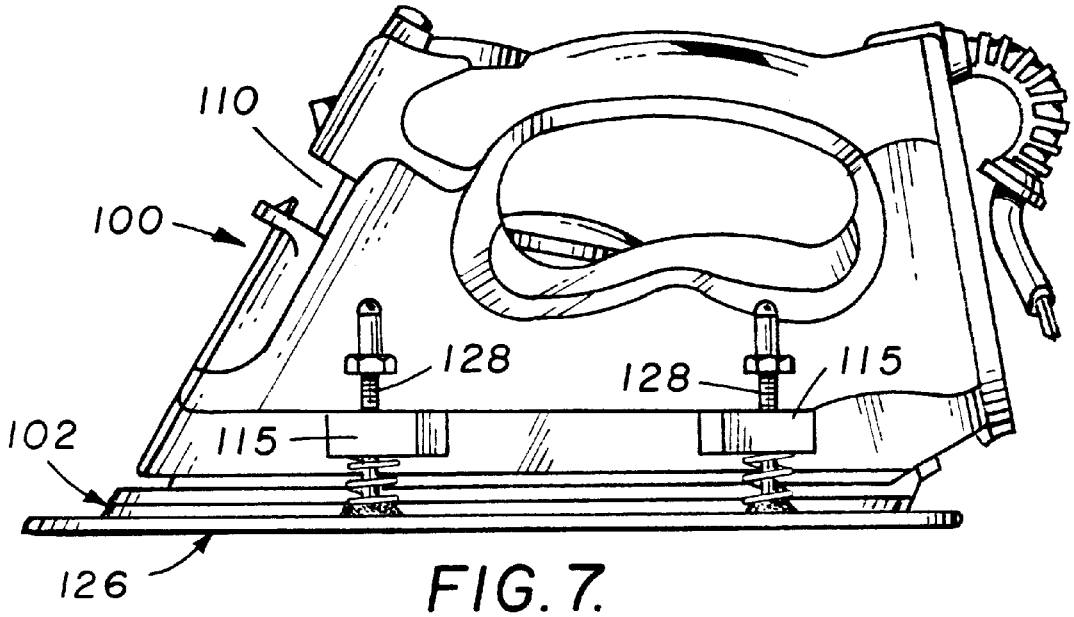
FIG. 7 is a side elevational view of the fourth embodiment of the invention depicted in FIG. 6 showing the outer skirt in its retracted position.
Figure 8:
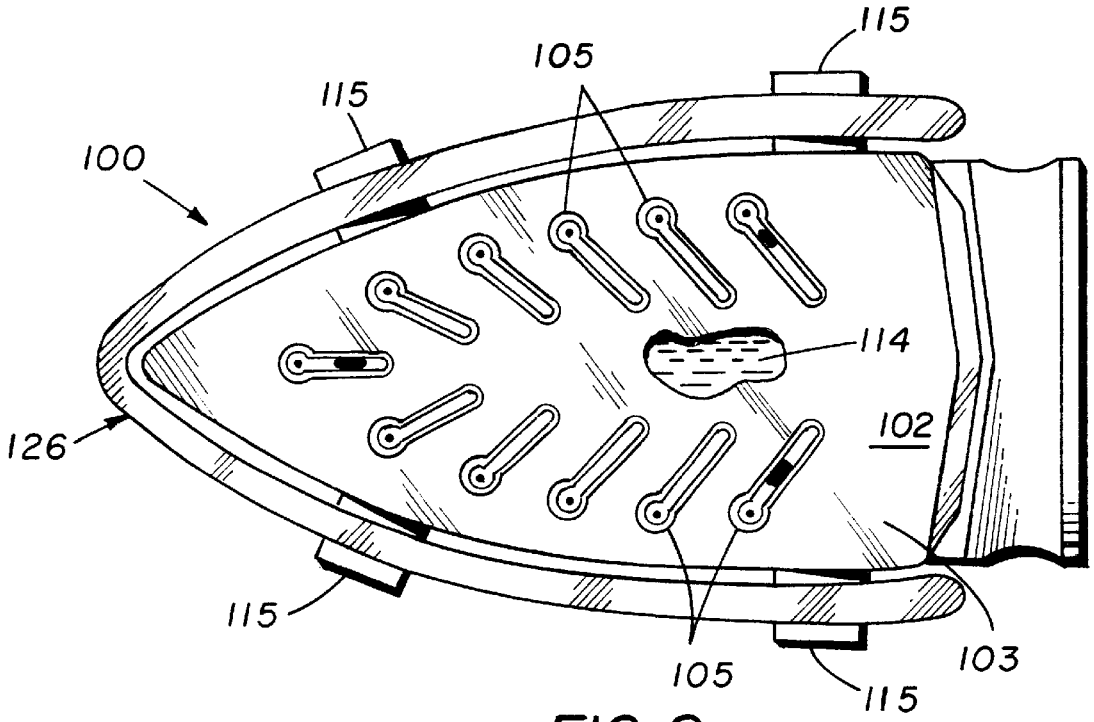
FIG. 8 is a bottom, partially broken away, view of the fourth embodiment of the electric steam iron depicted in FIGS. 6 and 7 and showing its sole plate, water reservoir, the openings for emitting steam, and the outer skirt.
Figure 9:
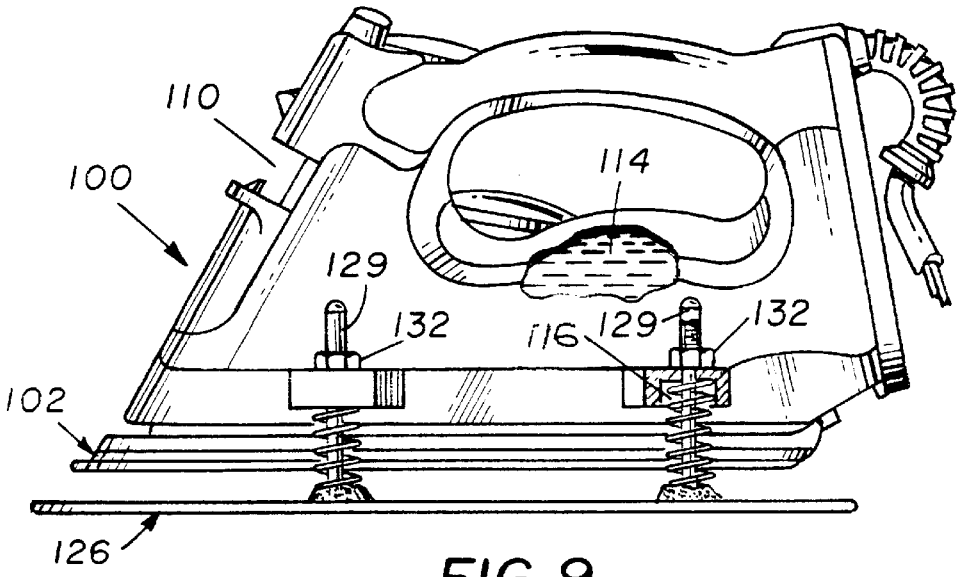
FIG. 9 is a side elevational, partially broken away and in cross section, view of the fourth embodiment of the invention depicted in FIGS. 6–8 showing the outer skirt in an extended position together with the details of the skirt supporting means.

FIGS. 6–9 illustrate, by way of example, a fourth embodiment of the flatiron 100 of the present invention. As best seen in FIG. 6, flatiron 100 generally comprises a metallic sole plate 102 with a lower surface 103 (FIGS. 6 and 8) having heating elements (not shown) incorporated therein in electrical contact in a conventional fashion to electrical leads 104, a plastic sheet (not shown) overlying the sole plate 102 for restricting the transfer of heat from sole plate 102 to other parts of flatiron 100 which are located above the sole plate 102 and the plastic sheet, a molded housing 106 having a handle 108, a water inlet 110 in communication with a water regulator 112 and a water source reservoir 114 within molded housing 106 incorporated above the upper surface of sole plate 102, and a plurality of spaced openings 105 (FIG. 8) in sole plate 102 for emitting steam onto a fabric material (not shown) to be ironed. The structure described hereinabove constitutes the major parts of most conventional steam electric flatirons 100. The improvements to the conventional steam electric flatiron 100 generally includes a plurality of non-heat-transmitting projections 115 secured to or made integral with the molded housing 106, an opening 116 (FIG. 9) in each projection 115, a skirt 126 which partially surrounds the sole plate 102 and whose inner dimensions are substantially larger than the outer dimensions of the sole plate 102, a plurality of skirt support members, rods, or bolts 128 which extend upwardly through the opening 116 in each projection 115, a coiled compression spring 130 mounted on and surrounding a portion of the skirt supporting members or rods 128, and an adjustment element or nut 132 mounted on each skirt supporting member or rod 128. A protective cap 129 (FIG. 9) may be placed on the upper end of each rod or bolt 128. As is apparent from FIGS. 6–9, the coiled compression springs 130 normally urge the skirt 126 downwardly and away from the sole plate 102.

The embodiment of the invention depicted in FIGS. 6–9 can be operated in either of two modes, namely: a natural up-mode when ironing material such as nylon, silk and rayon which can be easily scorched or burned, and a down-mode when ironing material such as cotton which is less likely to scorch or bum. In the natural up-mode, the skirt 126 due to it being urged below the lower surface 103 of metallic sole plate 102 by the coiled compression springs 130 rides over the material being ironed and in spaced relation thereto to reduce or eliminate the possibility of scorching or burning of a material being ironed when such material is nylon, silk or rayon. In the down-mode when a person applies pressure upon handle 108 of flatiron 100 during the actual ironing process, the pressure upon the handle 108 will cause the skirt 126 to move against the urging of coiled compression springs 130 to allow the lower surface 103 of metallic sole plate 102 to engage the material to be ironed during the ironing process. When the person releases the pressure upon handle 108 of flatiron 100, the compression springs 130 will urge the skirt 126 up to 2.5 centimeters or one inch below the lower surface 103 of metallic sole plate 102 to disengage contact between lower surface 103 of metallic sole plate 102 with the material to be ironed. As is apparent, by turning the nuts 132, the location of the skirt 126 relative to the sole plate 102 can be selectively adjusted to allow the skirt 126 to extend below the lower surface 103 of sole plate 102 anywhere from being in alignment with the lower surface 103 to approximately 2.5 centimeters or one inch below the lower surface 103.

Although I have shown the specific construction and arrangement of the parts and features constituting two preferred embodiments of my invention, changes may be made in the parts and features without departing from the proper scope and fair meaning of the accompanying claims and without affecting the operativeness of the invention.

What is claimed is:

1. An electric flatiron comprising a metallic sole plate having a lower surface and a plurality of steam emitting openings therein, a molded housing overlying and secured to said sole plate, a handle fixed to said molded housing, and resilient means for automatically lifting said sole plate above the material to be ironed to prevent scorching or burning of the material being ironed, said resilient means including a member in spaced relationship with said molded housing and said sole plate and partially surrounding said sole plate, said resilient means further including a plurality of protrusions fixed to said molded housing, an aperture in each of said protrusions, a rod passing through each of said apertures, a compression spring positioned over a portion of each of said rods for acting on a respective said protrusion and said member for normally urging said member away from said sole plate.

2. The electric flatiron of claim 1 wherein each of said rods has external threads at its upper end and is secured at its lower end to said member which partially surrounds said sole plate.

3. The electric flatiron of claim 2 wherein said resilient means further includes an internally threaded nut mounted on said upper threaded end of each said rod for adjusting the amount of compression upon said member which partially surrounds said sole plate to change the spaced relationship between said member and said sole plate.

4. The electric flatiron of claim 3 wherein said member which partially surrounds said sole plate is made of metal.

5. An electric steam iron having at least two modes of ironing operation, said iron comprising a metallic sole plate having a lower surface and a plurality of spaced steam emitting openings therein, a housing overlying and secured to said sole plate, a handle fixed to said housing, and resilient means associated with said housing, said resilient means including a member in spaced relationship with said sole plate and said housing responsive to pressure applied to said handle for selectively lifting and lowering said sole plate to control possible scorching or burning of material being ironed.

6. The electric iron of claim 5 wherein said sole plate is adapted to engage the material being ironed in one of said ironing modes of operation and disengaging the material being ironed in another of said modes of operation.

7. The electric iron of claim 5 wherein said resilient means further includes a plurality of protrusions fixed to said housing, an aperture in each of said protrusions, and a rod passing through each of said apertures, a compression spring positioned over each of said rods for acting on a respective said protrusion and said member in spaced relationship with said sole plate and said housing for normally urging said member away from said sole plate.

8. The electric iron of claim 7 wherein said member in spaced relationship with said sole plate and said housing partially surrounds said sole plate and wherein each of said rods has external threads at its upper end and is secured at its lower end to said member which partially surrounds said sole plate.

9. The electric iron of claim 8 wherein said resilient means further includes an internally threaded nut mounted on said upper threaded end of each said rod for adjusting the amount of compression upon said member which partially surrounds said sole plate to change the spaced relationship between said member and said sole plate.

10. The electric iron of claim 9 wherein said member which partially surrounds said sole plate is made of metal.

11. In combination with an electric steam iron having a metallic sole plate with a plurality of spaced steam emitting openings therein, said electric steam iron having at least two modes of ironing operation, a housing with a handle and a plurality of protrusions, and resilient means associated with said protrusions for normally lifting the sole plate of the steam iron above the material being ironed during one of said modes of operation to allow said sole plate to be disengaged from said material being ironed to prevent scorching or burning of the material being ironed, said resilient means including a member in spaced relationship with said molded housing and said sole plate.

12. The combination of claim 11 wherein said member in spaced relationship with said molded housing and said sole plate partially surrounds said sole plate.

13. The combination of claim 12 wherein said resilient means further includes a plurality of protrusions extending from said housing, an aperture in each of said protrusions, a rod passing through each of said apertures, a compression spring positioned over a portion of each of said rods for acting on a respective said protrusion and said member for normally urging said member away from said sole plate.

14. The combination of claim 13 wherein each of said rods has an upper and lower end with external threads on its said upper end and said lower ends being secured to said member which partially surrounds said sole plate.

15. The combination of claim 14 wherein said resilient means further includes an internally threaded nut mount on said upper threaded end of each said rod for adjusting the amount of compression upon said member which partially surrounds said sole plate to change the spaced relationship between said member and said sole plate.

16. The combination of claim 15 wherein said member partially surrounds said sole plate is made of metal.

* * * * *